US009511607B2

(12) United States Patent
LeFevre

(10) Patent No.: US 9,511,607 B2
(45) Date of Patent: Dec. 6, 2016

(54) PRINTHEAD PROTECTION DEVICE FOR DIRECT-TO-PAPER CONTINUOUS-FEED INKJET PRINTER

(71) Applicant: Xerox Corporation, Norwalk, CT (US)

(72) Inventor: Jason M. LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/531,122

(22) Filed: Nov. 3, 2014

(65) Prior Publication Data

US 2016/0121631 A1 May 5, 2016

(51) Int. Cl.

| | |
|---|---|
| ***B41J 25/312*** | (2006.01) |
| ***B41J 25/308*** | (2006.01) |
| ***B41J 25/32*** | (2006.01) |
| ***B41J 11/00*** | (2006.01) |
| *B41J 13/00* | (2006.01) |

(52) U.S. Cl.

CPC ..... *B41J 25/312* (2013.01); *B41J 11/0085* (2013.01); *B41J 11/0095* (2013.01); *B41J 25/308* (2013.01); *B41J 25/32* (2013.01); *B41J 13/0009* (2013.01)

(58) Field of Classification Search

CPC ..... B41J 25/312; B41J 25/308; B41J 25/32; B41J 13/0009

USPC ..... 347/8, 19, 16, 101

See application file for complete search history.

(56) References Cited

U.S. PATENT DOCUMENTS

| | | | | |
|---|---|---|---|---|
| 8,186,787 | B2 | 5/2012 | Holbrook et al. | |
| 8,690,276 | B2 | 4/2014 | Moore | |
| 2003/0042665 | A1* | 3/2003 | Ferrarese | B65H 5/38 271/3.14 |
| 2008/0012931 | A1 | 1/2008 | Gros et al. | |
| 2009/0085947 | A1* | 4/2009 | Kado | B41J 11/0085 347/16 |

* cited by examiner

*Primary Examiner* — Henok Legesse
(74) *Attorney, Agent, or Firm* — Maginot Moore & Beck LLP

(57) ABSTRACT

An imaging device includes a printhead and a detector configured to generate an electronic signal indicative of an increase in height in a portion of a media before such portion of the media passes the printhead. The imaging device also includes a vacuum source operable to pull the portion of the media having the increase in height away from the printhead so the media does not impact the printhead. The vacuum source is positioned below an opening in a platen opposite the printhead.

8 Claims, 4 Drawing Sheets

PRINTHEAD PROTECTION DEVICE FOR DIRECT-TO-PAPER CONTINUOUS-FEED INKJET PRINTER

TECHNICAL FIELD

This disclosure relates generally to imaging devices, and, in particular, printhead protection for inkjet printers.

BACKGROUND

Imaging devices such as inkjet printers typically operate one or more printheads that are configured to eject ink for marking media. In direct marking printers, the ink is applied directly on the media, rather than to an intermediate printing surface. The media can be, for example, a surface of a continuous web of media material, a series of media sheets, or other surfaces that are desirably marked. A printhead controller typically controls the one or more printheads by generating a firing signal with reference to image data.

In order for printed images to correspond closely to the image data, both in terms of fidelity to image objects and colors represented by the image data, the printheads are registered with reference to an image receiving surface of the media and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer.

Two or more printheads can be mounted linearly, or in other configurations, to a support structure, to form an array of printheads. Not only is registration between individual printheads important, but control of the registration of the supporting structure with respect to the image receiving surface is also desirable. A distance between the printheads and the imaging surface is carefully selected to optimize the imaging process. If the gap is too small, burnishing of the printheads can occur when the image receiving surface contacts the face of the printheads. Burnishing not only reduces the life of the printheads, but results in poor image quality, unintentional markings, and increased downtime of the printer during maintenance. If the gap is too large, image quality suffers, particularly in high speed printers, where a large gap can result in decreased accuracy of the ejected drops forming the printed image. A nominal gap distance between printheads and an image receiving surface can be, for example, about 1 mm or less.

The setting of a proper gap between a printhead and an image receiving surface is important where a printer is designed to accept a variety of imaging surfaces, including surfaces having a tendency to wrinkle, having different thicknesses, or having uneven surfaces. When the gap distance is small, even small variations in the height of the media can cause the media to impact and damage a printhead. Consequently, detecting the gap distance of the printhead array from the imaging surface and adjusting the gap distance appropriately are important considerations for image quality and printer operation. For example, media for a continuous feed printer can include seams where rolls of the media are spliced together, resulting in thicker sections of media that may not lie flat.

While vacuum belts and other hold-down systems, such as electrostatic hold-down systems, have been used to hold media flat against a surface, such systems are not usable to adjust the gap distance between the media and the printhead.

In other words, while a hold-down system might prevent a wrinkle from impacting the printhead by flattening out the wrinkle, a hold-down system would be ineffective when a height of the media increases, such as with a seam.

Previously known printers include an endless belt media transport with a vacuum hold-down system that holds a media flat against the endless belt as the media passes a printhead array. The printer also includes a sheet height sensor that determines whether a height of the media exceeds a threshold height with regard to a gap distance between the media and the printhead array. The printhead array and/or the media transport can be repositioned via actuators in response to a signal from the sheet height sensor in order to maintain a sufficient gap distance so that the media does not impact the printhead.

Moving the printhead array or the media transport supporting the media, even only briefly before returning to the nominal gap distance, however, introduces potential error with respect to registration of the printheads and the imaging surface. Even if relative motion between the media and the printhead array is slight, the printhead array must be reregistered in order to enable the printer to produce an accurate printed image. This process is repeated each time the gap distance needs to be adjusted, which may interrupt or delay the printing process. Actuating the media or the printhead array also requires significant portions of the printer to be on actuated frames which can be complex and expensive, as well as providing additional points of failure in the printer. Therefore, printhead protection that compensates for media surface variations without disturbing registration of the printhead would be useful.

SUMMARY

To protect one or more printheads in a printer from variations in media surfaces without disturbing printhead registration, a printer includes at least one printhead configured to eject ink onto media as the media passes by the at least one printhead, a detector configured to generate an electrical signal indicative of an increase in a height in a portion of the media before the portion of the media reaches the at least one printhead, a vacuum source configured to pull the portion of the media away from the at least one printhead, and a controller operatively connected to the detector and the vacuum source, the controller being configured to operate the vacuum source and pull the media away from the at least one printhead in response to the detector generating the electrical signal indicative of the increase in height of the portion of the media.

A method of operating a printer protects one or more printheads in an imaging device from variations in media surfaces without disturbing printhead registration. The method includes detecting an increase in height in a portion of media before the portion of media reaches a printhead of the imaging device, and actuating a vacuum source to pull the portion of the media away from the printhead as the portion passes by the printhead.

BRIEF DESCRIPTION OF THE DRAWINGS

The foregoing aspects and other features of the present disclosure are explained in the following description, taken in connection with the accompanying drawings.

DETAILED DESCRIPTION

Figure 1:
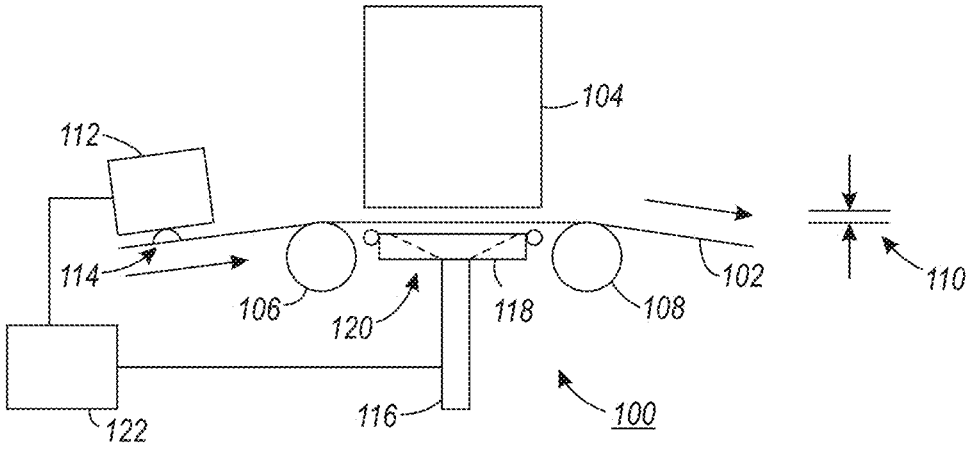
FIG. 1 is a schematic drawing of an imaging device having a vacuum source that is not active.

For a general understanding of the present embodiments, reference is made to the drawings. In the drawings, like reference numerals have been used throughout to designate like elements.

As used herein, the term "printer" generally refers to a device for producing an ink image on print media. "Print media" means a physical sheet of paper, plastic, or other suitable material that provides a surface for receiving ejected ink and forming durable ink images. The printer may include a variety of other components, such as finishers, paper feeders, and the like, and may be embodied as a copier, fax machine, or a multifunction machine. An ink image on print media corresponds to image data stored in a memory in electronic form that is used to generate electrical driving signals that are electrically connected to actuators to eject ink from one or more printheads onto the print media. The image data are rendered by a marking engine and such image data may include text, graphics, pictures, and the like.

As used herein, "height" of a print media means a thickness of the print media or a distance between a print surface of the print media and a surface which is supporting the print media. A "gap" or "gap distance" means a distance between the print surface of the media and a printhead. As noted above, a gap distance between the media and the printhead is carefully selected. A nominal gap distance between a printhead and the media is typically about 1 mm or less. Generally, a smaller gap is preferred in order to increase the accuracy of the printed image; however, the smallness of the gap is restricted since inkjet printheads are delicate and can easily be damaged if the face of the printhead is contacted by the media. Replacement of printheads can be expensive.

In continuous feed marking devices, the media, as it is manufactured, generally has seams. These seams occur when multiple rolls of media are spliced together to form the finished product used in the printer. A seam can consist of a section of overlapping media, or a butt-splice of the media with a seaming material to hold the adjacent pieces together. Because the seam is significantly thicker than the nominal media thickness and does not lie flush with the surface of the media, it poses a risk to the printhead, especially when gap distances are small. Other types of media distortions such as, for example, a wrinkle, a curl, or a fold, can result in an increase in height and thus also present a risk of the media impacting the printhead. In an example, a media sheet has a thicker portion where a peel-off label is disposed on a backing, or otherwise has a non-uniform thickness. Thus, minimizing risk of damaging printheads has a significant impact on the operability, efficiency, accuracy, and cost of the printer.

FIG. 1 illustrates a schematic of an imaging device 100 for printing an image onto a print media 102. The imaging device 100 includes a printhead 104 configured to eject ink onto the media 102 with reference to image data stored in a memory within the printer. Although depicted as a single element, the printhead 104 can be a plurality of printheads positioned in an array.

A first roller 106 is positioned to engage the media 102 before the media 102 reaches the printhead 104, and a second roller 108 is positioned to engage the media 102 after the media passes by the printhead 104. The first and second rollers 106, 108 are configured to support the media 102 on opposite sides of the printhead 104 such that marking of the media 102 by the printhead 104 occurs while the media 102 traverses a free-span between the first and second rollers 106, 108. In some embodiments, at least one of the first and second rollers 106, 108 has an encoder operable to locate the media 102 with reference to the printhead 104. Various other media transport mechanism (not shown) such as feeders, rollers, guides, etc., may also be included in the imaging device 100.

The first and second rollers 106, 108 are further positioned such that as the media 102 passes by the printhead 104, the media 102 is spaced apart from the printhead 104 by a first gap distance 110. In one embodiment, the first gap distance 110 is about 1 mm, and the first and second rollers 106, 108, with other transport mechanisms in the imaging device 100 are configured to provide approximately 2 pli (pounds per lineal inch) of tension to the media passing by the printhead 104.

To protect the printhead 104 from media strikes, the imaging device 100 further comprises a detector 112 configured to generate an electrical signal indicative of an increase in height 114 in the media 102, and a vacuum source 116 configured to pull a portion of the media 102 having the increase in height 114 away from the printhead 104 as that portion of the media 102 passes by the printhead 104. The detector 112 can include, for example, an optical sensor, or a mechanical sensor. In certain embodiments the detector 112 is operative to output a varying signal correlated with a detected height of the media 102. In other embodiments, the detector 112 is configured as a go/no-go sensor with a binary output that is dependent upon whether the media 102 exceeds a threshold height. In this case, the threshold height may be adjustable, for example, as a function of media type. The detector 112 is positioned such that the increase in height 114 in the media 102 is detected before the increase in height 114 reaches the printhead 104. The position of the detector 112 may be selected with reference to a time period needed to generate the electrical signal, a speed at which the media 102 passes by the printhead 104, and a response time of the vacuum source 116.

The vacuum source 116 is operable to produce a negative pressure to pull the portion of the media 102 with the increase in height 114 away from the printhead 104 as the portion passes by the printhead 104. In an example, the vacuum source 116 is a vacuum pump operable to produce approximately 2.5 kPa of negative pressure. As illustrated in FIG. 1, the imaging device 100 further includes a platen 118 positioned between the printhead 104 and the vacuum source 116 to enable the media to pass over the platen 118. The platen 118 has at least one opening 120 that is similar to opening 206 in platen 200 of FIG. 3 and that communicates with the vacuum source 116 to enable the vacuum source 116 to pull the media 102 against the platen 118 and away from the printhead 104.

A controller 122 is operatively connected to the detector 112 and the vacuum source 116. In some embodiments, the controller is also operatively connected to the printhead 104 or a printhead controller (not shown), or a transport mechanism configured to transport the media 102 within the imaging device 100. The controller can be integrated with another element, such as the detector 112, but in other embodiments the controller is a separate component. The controller is configured to operate the vacuum source 116 and pull the media 102 away from the printhead 104 responsive to the detector 112 generating the electrical signal indicative of the increase in height 114 of the media 102.

Figure 2:
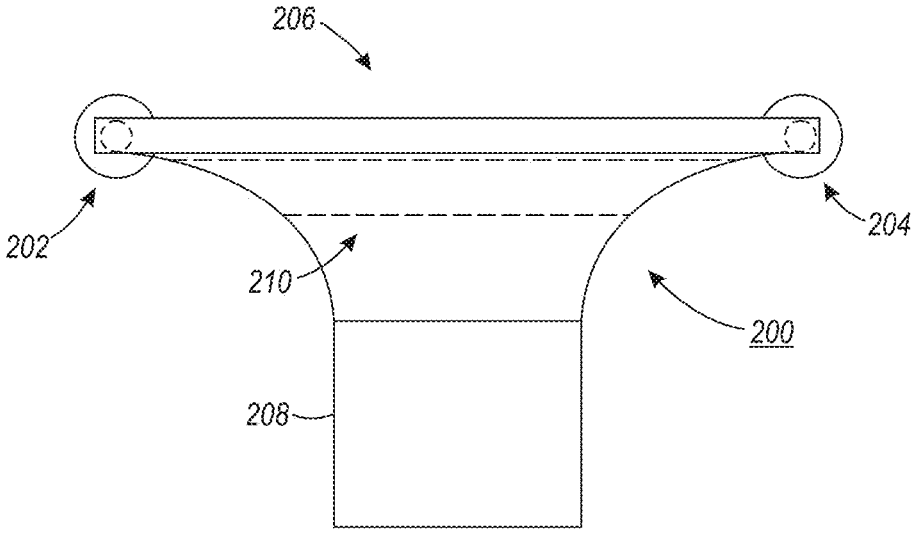
FIG. 2 is a side view of a platen and vacuum source.
Figure 3:
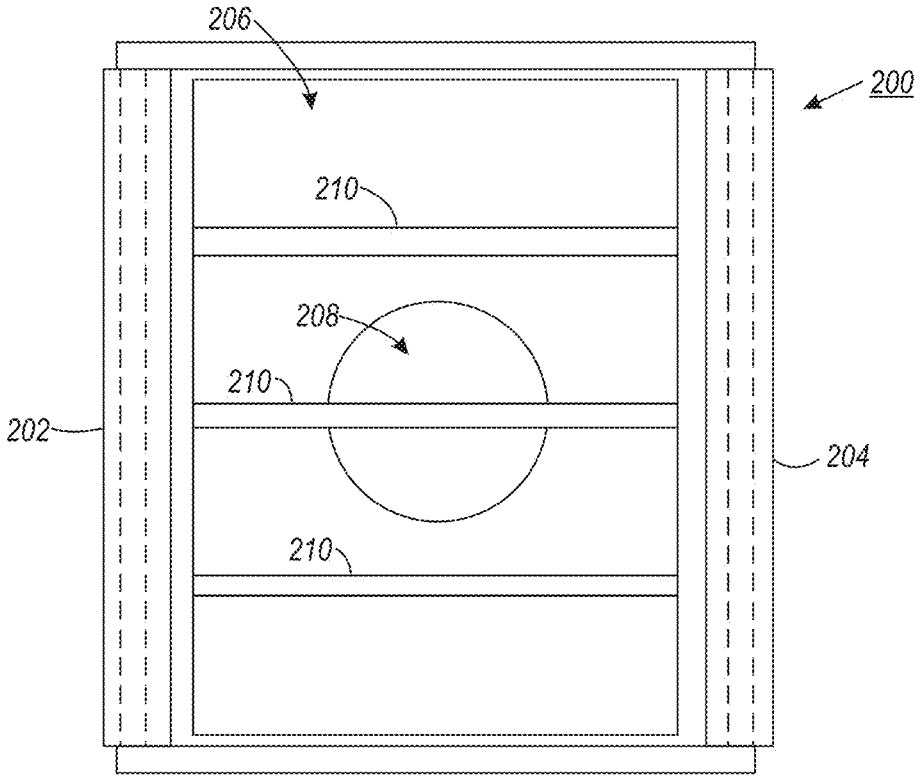
FIG. 3 is a top view of the platen and vacuum source of FIG. 2.

FIG. 2 illustrates a side view of a platen 200 usable in the imaging device 100 (FIG. 1), and FIG. 3 illustrates a top view of the platen 200. The platen 200 includes a third roller 202 positioned to transition the media 102 onto the platen 200 before the media 102 reaches the at least one printhead 104, and a fourth roller 204 positioned to transition the media 102 off the platen after the media 102 has passed by the at least one printhead 104. As illustrated in FIGS. 2 and 3, the third and fourth rollers 202, 204 are positioned on opposite sides of at least one opening 206 in the platen 200 that enables a vacuum source 208 to act on a media 102 passing over the platen 200.

The transitions provided by the third and fourth rollers 202, 204 enable reduction in drag that might otherwise be produced between a back-side of the media 102 and, for example, edges of the platen 200. Such back-side drag could otherwise distort or damage the media 102, and could produce a break in the media 102 that impacts the printhead 104. Other methods of reducing backside drag such as, for example, using low friction materials, or including a chamfer or radius on edges of the platen are also contemplated.

The platen 200 further includes at least one rib 210 that extends across the at least one opening 206 and is configured to support a portion of the media 102 being pulled by the vacuum source 208. While the platen 200 illustrated in FIGS. 2 and 3 includes three ribs 210 spanning a single opening 206, other numbers of holes and openings are also contemplated. Additional configurations for platens are also contemplated. In an example, rather than having ribs spanning an opening, a platen can comprise a surface with a plurality of openings, whereby the media passes along the surface of the platen when pulled by the vacuum source.

The at least one rib 210 and the surface of the platen 200 prevents the media 102 from being pulled farther away from the printhead 104 than is desirable. As the media 102 is pulled away from the printhead 104, the tension and/or drag acting on the media 102 increases. By acting as a limiter to the extent by which the media 102 can be pulled away from the printhead 104, the rib 210 and surface of the platen 200 enable operation of the vacuum source 116 without damaging the media 102.

In the embodiment illustrated in FIGS. 2 and 3, the at least one rib 210 extends over the at least one opening substantially in a direction in which the media 102 passes over the platen 100 so that the rib 210 supports the media 102 as it passes by the printhead 104. In other embodiments, other orientations of the at least one rib are also contemplated.

Figure 4:
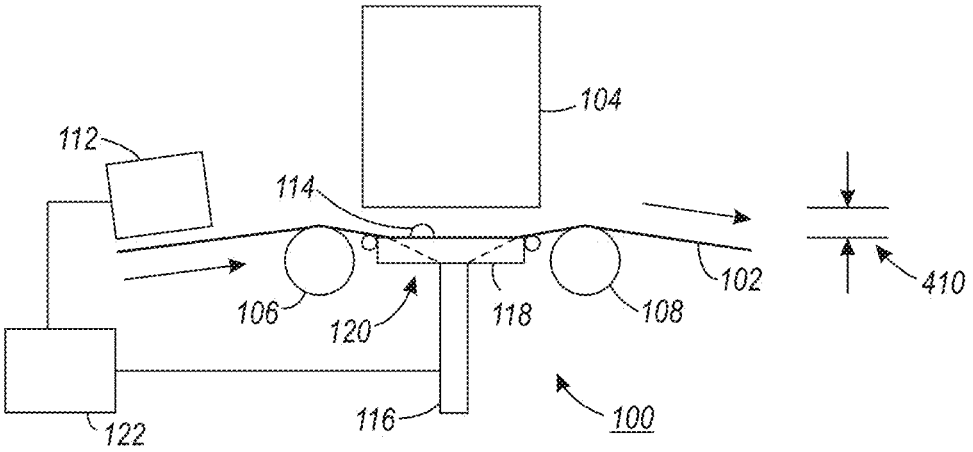
FIG. 4 is a schematic drawing of the imaging device of FIG. 1 where the vacuum source is active.

FIG. 4 illustrates a schematic of the imaging device 100 in which the vacuum source 116 is activated to pull the portion of the media 102 having the increase in height 114 away from the printhead 104 and against the platen 118. As a result of the pull from the vacuum source, the distance between the media 102 and the printhead 104 has been increased to a second gap distance 410 such that the increase in height 114 does not cause the media 102 to impact the printhead 104. In an example, the gap distance 410 has been increased to a value in a range from about 2 mm to about 4 mm. In one embodiment, the platen acts as an upper bound for the increase in value of the gap distance 410 and limits the extent to which the media 102 can be pulled away from the printhead 104.

The controller is further configured to operate the vacuum source 116 to pull the portion of the media 102 having the increase in height 114 away from the printhead 104 for a period of time determined with reference to a time at which the detector 112 generates the electrical signal indicative of the increase in height 114 and a speed at which the media passes by the printhead 104. In embodiments where the detector 112 is configured to output a varying signal correlated with a detected height of the media 102, the controller can be further configured to determine a value of the increase in height 114 of the media 102 and operate the vacuum source 116 at a negative pressure determined with reference to the value of the increase in height 114. For example, a smaller increase in height may require less negative pressure to pull the media away from the printhead 104 than necessary when a relatively larger increase in height occurs. In some embodiments, the negative pressure is determined with reference to properties of the media 102, such as thickness, stiffness, and weight.

In an embodiment, the vacuum source 116 is operable to produce a baseline negative pressure, and a flow control device (not shown) such as, for example, a choke or valve, is operated to regulate the negative pressure to a desired value. In one aspect, the vacuum source can be operated to produce the baseline negative pressure while the flow control is fully closed such that the negative pressure is prevented from acting on the media 102. Opening the flow control in such a state enables the negative pressure of the vacuum source 116 to act on the media 102 without waiting for an activation time of the vacuum source to transpire. For example, if the vacuum source is not generating a negative pressure when the controller receives the electrical signal from the detector 112, an activation time for the vacuum source 116 to generate the negative pressure must elapse before the media 102 can be pulled away from the printhead. However, if the baseline negative pressure has already been produced, the baseline negative pressure can be applied to the media 102 by opening the flow control device, and no activation time need elapse.

The controller is further configured to deactivate the vacuum source 116 after the portion of the media 102 having the increase in height 114 has passed by the printhead 104. This deactivation can occur at a time determined with reference to at least one of a second electrical signal generated by the detector 112 indicative of an end of the portion of the media 102 having the increase in height 114, a period of time elapsed since the detector generated the electrical signal indicative of the increase in height 114, and the speed at which the media passes by the printhead 104.

After the active operation time period of the vacuum source 116 has elapsed and the vacuum source 116 is deactivated, the media 102 is no longer pulled away from the printhead 104, and the gap distance 410 decreases back to the nominal value of the original gap distance 110 as shown in FIG. 1. Because the printhead 104 has not moved, and because the mechanisms supporting the media 102, i.e., the first and second rollers 106, 108, have not moved, re-registration of the printhead need not occur, and operation of the printhead 104 can continue uninterrupted.

In one embodiment, the printhead 104 is disabled while the vacuum source 116 is active. In an example, a break can be inserted into the printed image, whereby the printed image continues after the portion of the media 102 having the increase in height 114 has passed by the printhead 104.

However, in some cases, the size of the inserted break is minimized, and in some cases, inserting a break into the printed image at all is not desirable.

In one embodiment, the printhead 104 is operated for at least a portion of the period of time in which the vacuum source is active. For example, the printhead 104 can be controlled to operate while the vacuum source 116 is active but not for a period of time during which a region of the media 102 with the increase in height is underneath the printhead 104. In another example, operation of the printhead 104 is uninterrupted.

As described above, an increase in the gap distance 410 can negatively impact the accuracy of the printed image on the media 102. However, because the transport mechanisms of the imaging device 100 and the printhead 104 remain registered, and because the increase in the gap distance 410 due to the vacuum source 116 is a known value, the amount of error introduced due to the increase in gap distance can be quantified.

Figure 5:
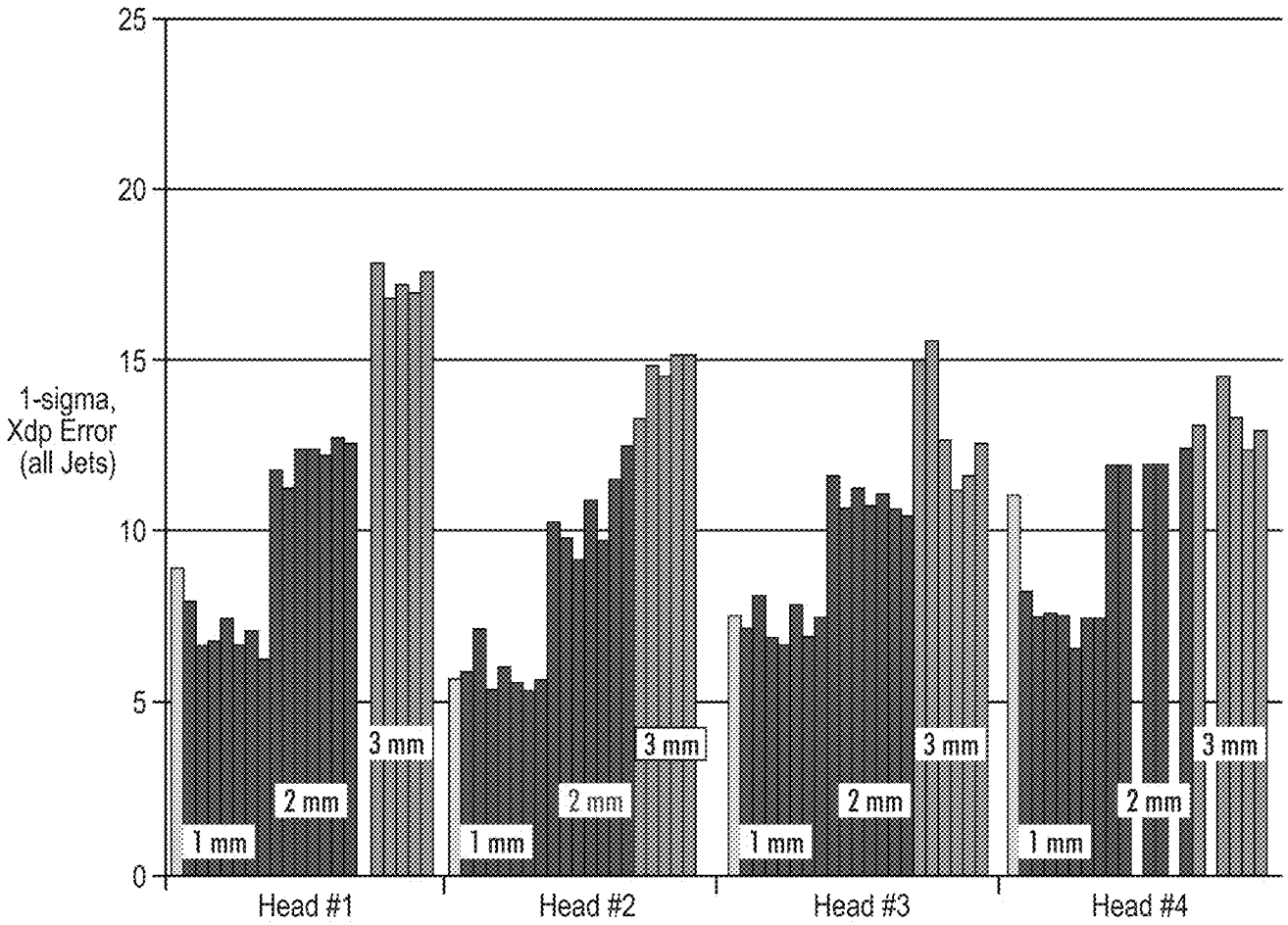
FIG. 5 is a graph of experimentally observed 1-Sigma error values for the location of print ink droplets at various gap distances between various printheads and a media.

Theoretically, an ejected ink drop does not deviate from a straight path and has a consistent flight time so the drop lands exactly on the page where it is expected. Drop placement $X_{dp}$ errors occur, however, as the distance between the printhead and the media increases. Generally, $X_{dp}$ errors have been observed to have a 1σ value of about 6-8 μm for a 1 mm gap distance, about 10-12 μm for a 2 mm gap distance, and about 12-17 μm for a 3 mm gap distance. FIG. 5 is a graph of experimental results illustrating the 1σ value of the $X_{dp}$ error for 12 pL drops of ink for 1 mm, 2 mm, and 3 mm gap distances for experimental printheads 1-4. As can be seen from FIG. 5, the increase in the $X_{dp}$ error is generally linear as the gap distance increases.

In an embodiment, a maximum gap increase is selected such that the $X_{dp}$ error is within a desired threshold. In another embodiment, operation of the printhead 104 is conducted with reference to a selected $X_{dp}$ error. For example, a drop size of the ink ejected from the printhead, a speed at which the media passes by the printhead 104, a size of a break inserted into a printed image, or image data for the image to be printed can be modified with reference to the $X_{dp}$ error.

Imaging devices according to this disclosure, such as the imaging devices illustrated in FIGS. 1 and 4, can include a plurality of printheads. In one example, media passes between a vacuum source and an array of printheads. In another example, a plurality of printhead/vacuum source configurations similar to the configuration illustrated in FIGS. 1 and 2 are positioned in series. Different printheads can be operable to eject different colors or types of ink, and can be operable to print on different types and sizes of media. In an example, an imaging device can be configured to print images on a variety of media having different widths, and different printhead-vacuum source configurations within the imaging device are adapted to operate with media of different widths.

Figure 6:
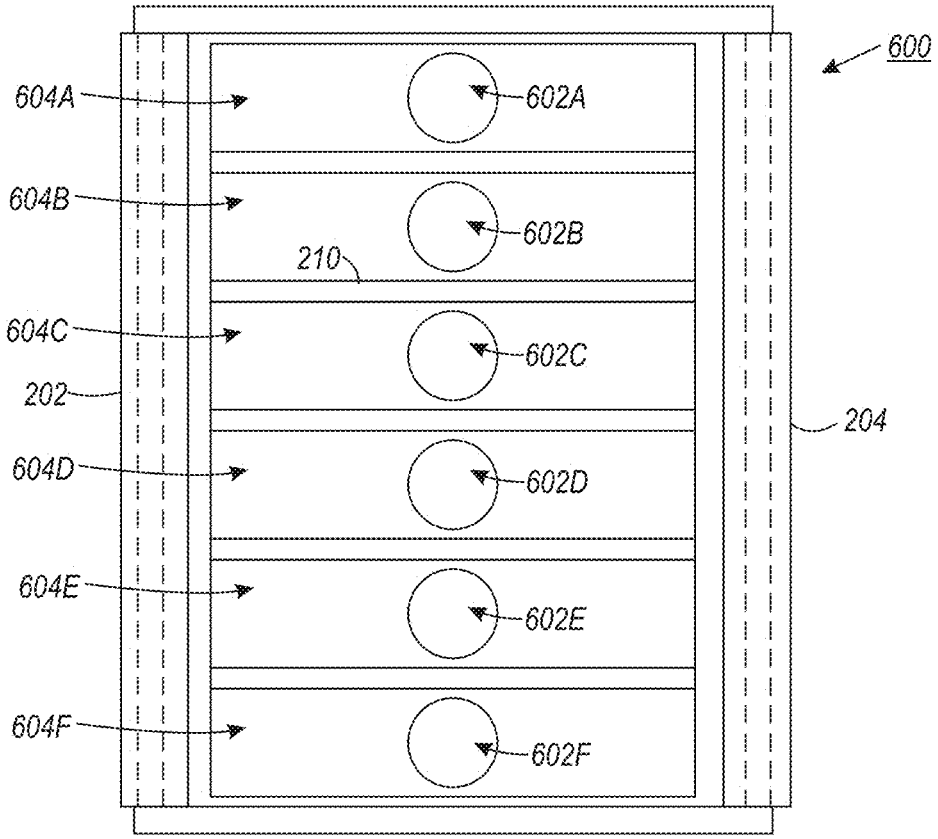
FIG. 6 is a top view of an exemplary embodiment of a platen and a plurality of vacuum sources.

In a further example, a width of the at least one opening in the platen 200 is adjustable to comport with a width of a media currently in use in the imaging device. In another example, FIG. 6 illustrates a top view of a platen 600 wherein a plurality of vacuum sources 602*a-f* are in communication with a plurality of openings 604*a-f* in the platen 600. Other numbers of vacuum sources 602 are also contemplated. The vacuum sources 602*a-f* are selectively operable, such that vacuum sources in communication with openings that comport with a width of the media currently being used in the imaging device can be selectively activated.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claim is:

1. A printer comprising:

at least one printhead configured to eject ink onto media as the media passes by the at least one printhead;

a detector configured to generate an electrical signal indicative of an increase in a height that is present in a portion of the media before the portion of the media reaches the at least one printhead;

a vacuum source configured to pull the portion of the media having the increase in height away from the at least one printhead as the portion of the media passes the at least one printhead; and a controller operatively connected to the detector and the vacuum source, the controller being configured to operate the vacuum source to pull the portion of the media having the increase in height away from the at least one printhead and increase a gap distance between the at least one printhead and the portion of the media having the increase in height for a time period determined with reference to a time at which the detector generates the electrical signal indicative of the increase in the height in the portion of the media and a speed at which the media is passing by the at least one printhead and then deactivate the vacuum source to increase a gap distance between the at least one printhead and the media following the portion of the media having the increase in height.

2. The printer of claim 1 further comprising:

a platen positioned between the at least one printhead and the vacuum source to enable the media to pass over the platen, the platen having at least one opening that enables vacuum source to pull the media against the platen and away from the at least one printhead.

3. The printer of claim 2 further comprising:

a first roller positioned to transition the media onto the platen before the media reaches the at least one printhead.

4. The printer of claim 2 further comprising:

a second roller positioned to transition the media off the platen after the media has passed by the at least one printhead.

5. The printer of claim 2, the platen further comprising:

at least one rib extending across the at least one opening to support the portion of the media being pulled by the vacuum source.

6. The printer of claim 5 wherein the at least one rib spans the at least one opening substantially in a direction in which the media passes by the at least one printhead.

7. The printer of claim 1 further comprising:

a first roller positioned to engage the media before the media reaches the at least one printhead; and a second roller positioned to engage the media after the media passes by the at least one printhead, the first and second roller being configured to support the media on opposite sides of the at least one printhead.

8. The printer of claim 1, the controller being further configured to:

deactivate the vacuum source at a time determined with reference to:

an electrical signal generated by the detector indicative of an end of the portion of the media having an increase in height; and a speed at which the media is passing by the at least one printhead.

* * * * *